United States Patent [19]

Ishikawa

[11] Patent Number: 4,980,915

[45] Date of Patent: Dec. 25, 1990

[54] CENTER MODE CONTROL CIRCUIT

[75] Inventor: Tsutomu Ishikawa, Gunma, Japan

[73] Assignee: Sanyo Electric Co., Ltd., Moriguchi, Japan

[21] Appl. No.: 390,057

[22] Filed: Aug. 7, 1989

[30] Foreign Application Priority Data

Aug. 12, 1988 [JP] Japan ..... 63-202225

[51] Int. Cl.[5] ..... H04S 3/00

[52] U.S. Cl. ..... 381/27

[58] Field of Search ..... 381/1, 27, 19, 20, 21, 381/22, 23

[56] References Cited

U.S. PATENT DOCUMENTS 3,016,424 1/1962 Franke ..... 381/27

OTHER PUBLICATIONS

"Nikkei Electronics", issued Jun. 27, 1988; pp. 88–89.

*Primary Examiner*—Forester W. Isen

*Attorney, Agent, or Firm*—Armstrong, Nikaido, Marmelstein, Kubovcik & Murray

[57] ABSTRACT

A center mode control circuit includes an amplifying portion (31) for amplifying a center input signal, a switch (34) connected to an input terminal of the amplifying portion, and capacitors (35, 36) selected by the switch and having different characteristic from each other. The modes that are switched are (a) a normal mode for adding a low frequency component of the center input signal to left and right input signals, (b) a phantom mode for adding a full range of the center input signal to the left and the right stereo input signals, and (c) a wide mode for not adding the center input signal to the left and the right stereo input signals.

5 Claims, 2 Drawing Sheets

CENTER MODE CONTROL CIRCUIT

BACKGROUND OF THE INVENTION

1. Field of the Invention

The present invention relates to a center mode control circuit, and more specifically, to a center mode control circuit employed, for example, in a Dolby Pro Logic Surround Decoder, and suitable for an IC (Integrated Circuit).

2. Description of the Background Art

An article regarding to Dolby Pro Logic Surround System proposed by Dolby Laboratories Licensing Corp. of the United States appears on pp. 88–89 in "NIKKEI Electronics" issued on June 27, 1988. As shown in FIG. 2, the system is comprised of left and right input terminals 1 and 2 to which left and right stereo signals $L_T$ and $R_T$ are applied. A first adder circuit 3 adds the left and right stereo signals $L_T$ and $R_T$ to generate a sum signal C' ($=L_T+R_T$), a subtractor circuit 4 subtracts the right stereo signal $R_T$ from the left stereo signal LT to generate a difference signal S' ($=L_T-R_T$). First and second detection circuits 5 and 6 respectively detect levels of the left and right stereo signals $L_T$ and $R_T$. Third and fourth detection circuits 7 and 8 respectively detect levels of the sum and difference signals C' and S'. A first level ratio detection circuit 9 level ratio of output signals of the first and second detection circuit 5 and 6. A second level ratio detection circuit 10 detects the level ratio of output signals of the third and fourth detection circuits 7 and 8. A VCA (Voltage Controlled Amplifier) 11 includes a plurality of gain controlled amplifier circuits (not shown), each controlling the level of the left or right stereo signal $L_T$ or $R_T$ in response to any one of the output signals of the first and second level ratio detection circuits 9 and 10. A second adder circuit 12 selectively adds the left and right stereo signals and output signals of the VCA 11 to generate left and right stereo output signals L and R, a center output signal C and a surround output signal S. A center mode control circuit 13 switches between the left and right stereo output signals L and R and the center output signal C in response to a mode, and a passive decoder 14 performs signal processing such as delay and noise reduction to the surround output signal S. Therefore, a structure such as shown in FIG. 2 enables a signal processing of enhancement of direction to clarify surround localization of sound, so that acoustics having presence can be provided to listeners Particularly, the system is effective when applied to an audio signal processing of a large-sized television, so that it can produce the same effect on an audience as is obtained in seeing a picture at a theater.

The center mode control circuit is disposed in order to switch for a normal mode, a phantom mode and a wide mode. In a normal mode, only a low frequency component of the center output signal C is added to the left and the right stereo output signals L and R. In a phantom mode, a full range of the center output signal C is added to the left and the right stereo output signals L and R. In a wide mode, nothing is added, and the left and the right stereo output signals L and R are generated as they are.

FIG. 3 is a circuit diagram showing an example of the conventional center mode control circuit, wherein left and right stereo input signals L and R, applied to left and right input terminals 15 and 16, are directly applied to first and second adder circuit 17 and 18, respectively.

A center input signal applied to a center input terminal 19 is passed through a low pass filter 20 or a high pass filter 21, or directly transferred to terminals of first and second switches 22 and 23. The signal passed through the first switch 22 is applied to an attenuation circuit 24, wherein it is attenuated by 3 dB to be applied to the first and the second adder circuits 17 and 18, while the signal passed through the second switch 23 is provided to a center output terminal 25 as a center output signal $C_O$.

States of the left and the left stereo output signals $L_O$ and $R_O$ and the center output signal $C_O$ in each mode will be described. In a normal mode, an output signal of the low pass filter 20 is applied to the first and the second adder circuits 17 and 18 through the first switch 22 and the attenuation circuit 24. As a result, the left stereo output signal $L_O$ becomes a signal obtained by addition of the left stereo input signal L and the high frequency cut off center input signal $C_L$, the right stereo output signal $R_O$ becomes a signal obtained by addition of the right stereo input signal R and a high frequency cut off center input signal $C_L$, and the center output signal $C_O$ becomes a high frequency center input signal $C_H$. In a phantom mode, the center input signal C is applied to the first and the second adder circuits 17 and 18 through the attenuation circuit 24. As a result, the left stereo output signal $L_O$ becomes L+C, while the right stereo signal $R_O$ becomes R+C. In a wide mode, since the first switch 22 is opened while the second switch 23 selects the center input signal C, the left and the right stereo input signals L and R become the left and right stereo output signals $L_O$ and $R_O$, respectively, and the center output signal $C_O$ becomes equal to the center input signal C.

Accordingly, the circuit of FIG. 3 enables an accurate center mode controlling.

However, the circuit of FIG. 3 had a problem in that it required the low pass filter 20 and the high pass filter 21, so that adjustment of characteristics of these filters was difficult. In addition, when this circuit is implemented as an integrated circuit, the low pass filter 20, the high pass filter 21 and the first and the second switches 22 and 23 should be externally attached to the IC, thereby increasing the number of pins for external attachment, so that it was not suitable for an integrated circuit.

SUMMARY OF THE INVENTION

An object of the present invention is to provide a center mode control circuit in which adjustment of filter characteristics is not necessary.

Another object of the present invention is to provide a center mode control circuit having the fewer number of parts to be externally attached, and suitable for an integrated circuit.

A center mode control circuit according to the present invention, comprises an amplifying portion for amplifying a center input signal, a switch connected to an input of the amplifying portion, and capacitors to be selected by the switch and having different characteristics to each other, wherein a normal mode, a phantom mode and a wide mode can be switched by controlling the switch.

According to the present invention, a mode can be selected only by controlling the switch connected to the input end of the amplifying portion. In this case, if the switch is set to the normal position, a capacitor for grounding only the high frequency component of the center input signal is connected to &.he input end of the amplifying portion, so that only the low frequency component of the center input signal can be added to the left and the right stereo input signals. If the switch is set to the phantom position, the input end of the amplifying portion becomes open, so that a full range of the center input signal can be added to the left and the right stereo input signals. In addition, if the switch is set to the wide position, a capacitor for grounding the full range of the center input signal is connected to the input end of the amplifying portion, so that no adding is performed. Therefore, according to the present invention, switching of the switch connected to the input end of the amplifying portion enables selection of three modes.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
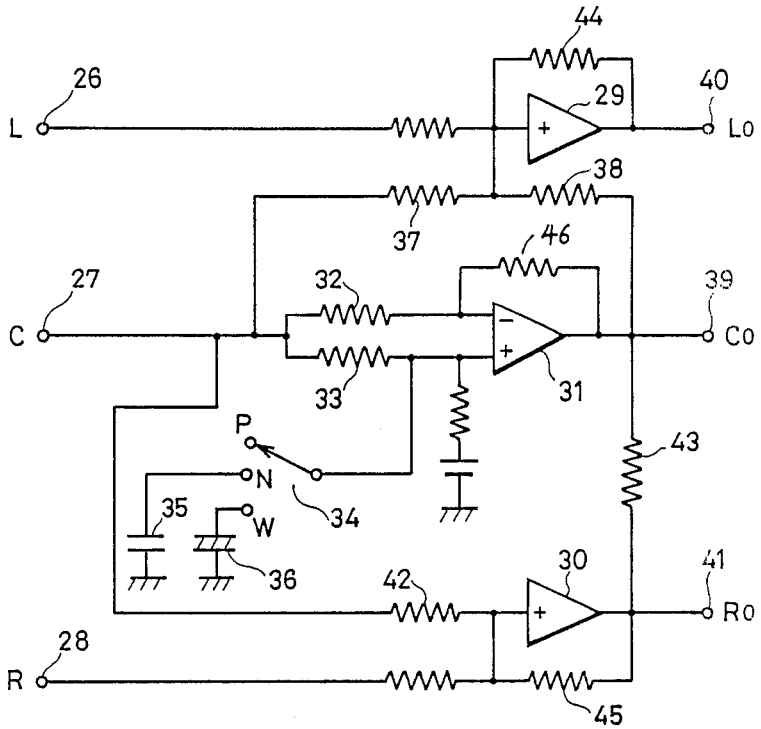
FIG. 1 is a circuit diagram showing one embodiment of the present invention.
Figure 3:
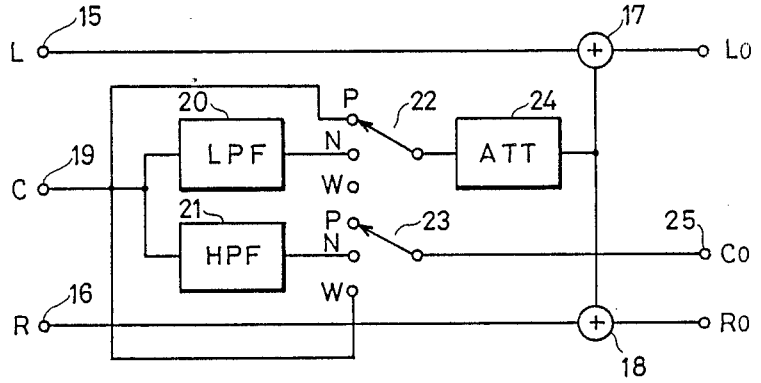
FIG. 3 PRIOR ART
FIG. 3 is a circuit diagram showing a conventional center mode control circuit.
Figure 2:
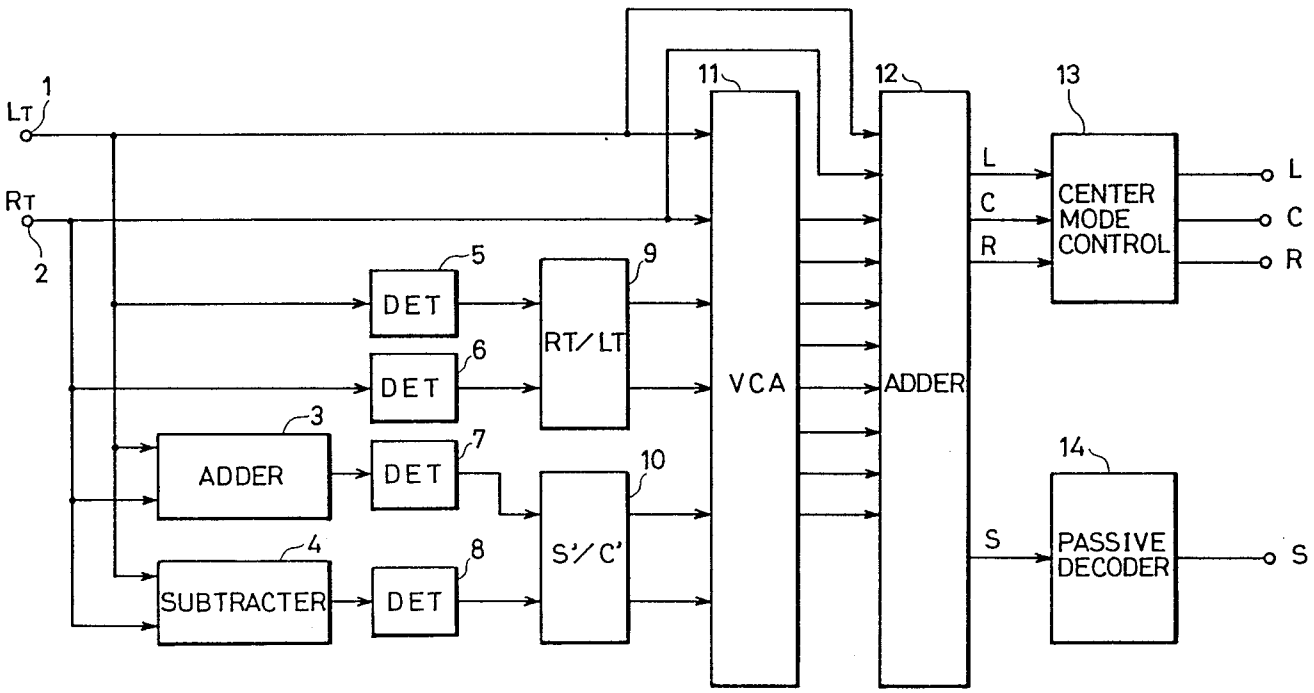
FIG. 2 PRIOR ART
FIG. 2/is a schematic block diagram showing a surround-decoder system to which a center mode control circuit of the present invention is applied.

FIG. 1 is a circuit diagram showing one embodiment of the present invention, wherein 26 denotes a first input terminal to which a left stereo input signal L is applied, 27 denotes a second input terminal to which a center input terminal C is applied, and 28 denotes a third input terminal to which a right stereo input signal R is applied. A first adding and amplifying circuit 29 adds the left stereo input signal L and the center input signal. A second adding and amplifying circuit 30 adds the right stereo input signal R and the center input signal C. An inversion amplifier circuit 31 having its positive and negative input terminals connected through a resister 33 and 32, respectively, to the second input terminal 27. A switch 34 is connected to the positive input terminal of the inversion amplifier circuit. A first capacitor 35 is connected to a second fixed terminal of the switch 34, for grounding the high frequency component of the center input signal. A second capacitor 36 is connected to a third fixed terminal of the switch 34, for grounding the full range of the center input signal.

If a movable contact of the switch 34 is connected to the second fixed contact to select a normal mode, all of the center input signal is applied to the negative input terminal of the inversion amplifier circuit 31 through the resister 32, while only the low frequency components of the center input signal are applied to the positive input terminal of the inversion amplifier circuit 31. At this time, since the feedback resistor 46 is connected between the negative input terminal and the output terminal of the inversion amplifier circuit 31, the inversion amplifier circuit 31 operates as a negative feedback amplifier circuit, so that a center input signal high frequency component $C_H$ of opposite polarity is generated at a second output terminal 39. The center input signal high frequency component of opposite polarity is added to the center input signal by means of addition resistors 37 and 38, so that consequently, a center input signal low frequency component $C_L$ is applied to the first adding and amplifying circuit 29 to be added to the left stereo input signal L. As a result, a sum signal $L_O$ $(=L+C_L)$ of the left stereo input signal L and the center input signal low frequency component $C_L$ is generated at a first output terminal 40. Similarly, a signal $R_O$ $(=R+C_L)$ obtained by addition of the right stereo input signal R and the center input signal low frequency component $C_L$ is generated at a third output terminal 41.

In a normal mode, low frequency components of the center input signal are added to the left and the right stereo input signals, so that low frequency compensation becomes possible, when as a center speaker, a compact one without producing bass is used.

If the movable contact of the switch 34 is connected to a first fixed contact to select a phantom mode, the center input signal is simultaneously applied to the positive and the negative input terminals of the inversion amplifier circuit 31, so that no output signal is generated at the output terminal of the inversion amplifier circuit 31. Therefore, the center input signal C is applied to the first and the second adding and amplifying circuits 29 and 30 through the addition resistances 37 and 38, 42 and 43, respectively, to be added to the left and the right stereo input signals L and R. As a result, a sum signal $L_O$ $(=L+C)$ of the left stereo input signal L and the center input signal C is generated at the first output terminal 40, sum signal $R_O$ $(=R+C)$ of the right stereo input signal R and the center input signal C is generated at the third output terminal 41, and no output signal is generated at the second output terminal 39.

In a phantom mode, the center input signal is added to the left and the right stereo input signals, so that it becomes a suitable mode especially for a system without a center speaker.

If the movable contact of the switch 34 is connected to a third fixed contact to select a wide mode, the center input signal is applied only to the negative input terminal of the inversion amplifier circuit 31, so that an inverted signal of the center input signal is obtained at the output terminal of the inversion amplifier circuit 31. The inverted signal is added to the center input signal by means of the addition resistors 37, 38, 42 and 43 to be cancelled. Therefore, only left and right stereo input signals L and R are respectively applied to the first and the second adding and amplifying circuits 29 and 30, and the left and the right stereo input signals L and R are generated respectively at the first and the third output terminals 40 and 41 as the output signals $L_O$ and $R_O$, while the center input signal C is generated as the output signal $C_O$ at the second output terminal 39.

In a wide mode, the left and the right stereo input signals L and R and the center input signal C are applied respectively to a speaker as the left and the right stereo output signals $L_O$ and $R_O$ and the center output signal $C_O$, thereby forming a normal surround system.

When adding is performed in the first and the second adding and amplifying circuit 29 and 30, a level of the center input signal C is decreased by 3 dB to be added to the left and the right stereo input signals L and R in order not to increase the sound volume during adding. This can be performed by adequately setting the ratio of the feedback resistors 44 and 45 of the first and the second adding and amplifying circuits 29 and 30, and the addition resistors 37 and 38, 42 and 43.

As described above, according to the embodiments of the present invention, in processing a center input signal to generate a signal to be added to left and right stereo input signals, a center mode control circuit can be comprised of only high pass inversion amplifier circuits, so that setting of characteristics is facilitated, and thereby providing a center mode control circuit with small dispersion. In addition, in integration of circuits, since the mode can be switched only by using an input terminal of an amplifying portion as an external pin to be externally connected to a switch, the center mode control circuit according to the present invention is suitable for integration of circuits.

Although the present invention has been described and illustrated in detail, it is clearly understood that the same is shown as an illustration and an example only and is not to be taken as a limitation, the spirit and scope of the present invention being limited only by the terms of the appended claims.

What is claimed is:

1. A center mode control circuit for switching of a normal mode for adding a low frequency component of a center input signal to left and right stereo input signals, a phantom mode for adding a full range of said center input signal to said left and right stereo input signals, and a wide mode for not adding said center input signal to said right and left stereo input signals, the center mode control circuit comprising:

amplifying means for amplifying said center input signal;

switching means connected to an input terminal of said amplifying means for switching a mode of said control circuit to at least one of the normal, phantom and wide modes, and first and second capacitor means selected by said switching means and having different characteristics from each other.

2. A center mode control circuit according to claim 1, wherein said amplifying means includes positive and negative input terminals and an output terminal, and said switching means connected to the positive input terminal of said amplifying means, for switching a state of said positive input terminal via said first and second capacitor means to be at least one of open, connected to a high pass capacitor of said first capacitor means and connected to a full pass capacitor of said second capacitor means.

3. A center mode control circuit according to claim 1, wherein at least said amplifying means and said first and second capacitor means are formed in a single integrated circuit, and said switching means is connected to an external pin of said integrated circuit.

4. A center mode control circuit comprising:

a first signal path for a left stereo input signal, a second signal path for a center signal, a third signal path for a right stereo input signal, a high pass inversion amplifier means connected to said second signal path;

first adder means for adding an input signal and an output signal of said high pass inversion amplifier means to said left stereo input signal applied to said first signal path;

a second adder means for adding the input signal and the output signal of said high pass inversion amplifier means to said right stereo input signal applied to said third signal path; and switching means for switching so that the output signal of said high pass inversion means becomes at least one of a high pass signal, a full range signal and a zero signal of said center signal.

5. A center mode control circuit according to claim 4, wherein said center mode control circuit is formed in a single integrated circuit, and said switching means is connected to an external pin of said integrated circuit.

* * * * *